United States Patent [19]

Mattei et al.

[11] Patent Number: 4,676,360

[45] Date of Patent: Jun. 30, 1987

[54] METHOD OF SPACING AND TURNING OVER TWO COAXIAL CIGARETTE LENGTHS ON FILTER ASSEMBLING MACHINE

[75] Inventors: Riccardo Mattei; Gastone Dall'Osso, both of Bologna, Italy

[73] Assignee: G.D Societa' per Azioni, Bologna, Italy

[21] Appl. No.: 679,691

[22] Filed: Dec. 10, 1984

[30] Foreign Application Priority Data

Dec. 20, 1983 [IT] Italy ..... 3662 A/83

[51] Int. Cl.[4] ..... B65G 47/24

[52] U.S. Cl. ..... 198/377; 198/458; 198/474.1

[58] Field of Search ..... 198/471.1, 474.1, 803.4, 198/458, 377, 408, 951; 131/282

[56] References Cited

U.S. PATENT DOCUMENTS

| | | | |
|---|---|---|---|
| 3,215,250 | 11/1965 | Schubert | 198/951 |
| 3,973,671 | 8/1976 | Schwenke | 198/951 |
| 4,200,179 | 4/1980 | Hinz | 198/458 |
| 4,577,644 | 3/1986 | Grieben | 198/951 |

*Primary Examiner*—Joseph E. Valenza

*Attorney, Agent, or Firm*—Marshall, O'Toole, Gerstein, Murray & Bicknell

[57] ABSTRACT

Method of spacing and turning over two coaxial cigarette lengths on a filter assembling machine, the said method providing for stages consisting in feeding the said lengths crosswise in relation to their axes along a conveyor provided, for each length, with a recess mounted so as to turn on the said conveyor round an axis essentially crosswise in relation to the direction of the said conveyor, and in turning the said recesses through 180° in relation to the said conveyor so as to set the former opposite ends of the said two lengths facing each other at a distance equal to at least the length of a double filter.

6 Claims, 4 Drawing Figures

METHOD OF SPACING AND TURNING OVER TWO COAXIAL CIGARETTE LENGTHS ON FILTER ASSEMBLING MACHINE

BACKGROUND OF THE INVENTION

The present invention relates to a method of spacing and turning over two coaxial cigarette lengths on a filter assembling machine.

Cigarette manufacturing machines are known to produce a continuous cigarette rod which, before being fed on to a filter assembling machine, is cut crosswise, usually not too neatly, into double cigarette lengths, i.e. lengths twice as long as the tobacco-filled part of a filter cigarette.

The said double lengths are then usually fed into respective recesses or slots on a splined roller at the input of a filter assembling machine, on which roller they are fed towards a cutting station where a disc cutter cuts the double lengths extremely accurately in half. The effect of this operation is to produce, inside each slot on the said input roller, two coaxial cigarette lengths essentially contacting each other over perfectly smooth end surfaces.

According to one known method of manufacturing filter cigarettes, the said two cigarette lengths are spaced apart in such a manner as to accommodate a double filter inbetween, i.e. a length of filter twice as long as that of a single cigarette. The said double filter is then banded to both the said cigarette lengths and the double cigarette so formed cut halfway along the double filter, so as to produce two single filter cigarettes.

One drawback on cigarettes produced this way is that the free end opposite the filter, though generally flat, is not always cut neatly, owing to its being produced by a propeller-type knife cutting the continuous cigarette rod crosswise as it comes off the said manufacturing machine.

On a known filter assembling machine, this drawback has been overcome by offsetting the said two cigarette lengths by means of rolling, moving one of the two lengths axially over to the opposite side of the other and then re-aligning the two lengths, usually by means of a second rolling operation, before inserting the said double filter.

By so doing, the perfectly smooth end faces on the two cigarette lengths are shifted outwards and the rough-cut ends inward facing each other. The latter are then connected to the opposite ends of the double filter, so as to produce essentially perfect finished cigarettes.

One drawback of the abovementioned method is that relative displacement of the two cigarette lengths for positioning the perfectly smooth end face outward involves two rolling operations and relatively long axial displacement of one cigarette length in relation to the other. Such operations usually result in tobacco leakage and invariably weaken the cigarette structure, in addition to impairing the resistance of the cigarettes to subsequent handling during packing.

SUMMARY OF THE INVENTION

The aim of the present invention is to provide a method of producing filter cigarettes having perfectly smooth free ends and involving no weakening of the cigarette structure and no tobacco leakage.

With this aim in view, the present invention relates to a method of spacing and turning over two coaxial cigarette lengths on a filter assembling machine, characterised by the fact that it comprises stages consisting in:

conveying the said two cigarette lengths, arranged essentially contacting each other over a first end face, on a conveyor travelling in a direction essentially perpendicular to the axis of the said cigarette lengths, the said conveyor comprising, for each pair of the said cigarette lengths, two coaxial recesses mounted so as to turn on the said conveyor round respective axes of rotation essentially crosswise in relation to the said travelling direction, and turning the said two recesses essentially 180° round the respective said axes of rotation, so as to make them once more coaxial with each other; the said axes of rotation of the said two recesses being set apart in such a manner that, when turned through the said 180°, the said two cigarette lengths are arranged with their second ends facing each other and separated by at least the length of a double filter.

BRIEF DESCRIPTION OF THE DRAWINGS

The invention will now be described with reference to the attached drawings in which.

DETAILED DESCRIPTION OF THE INVENTION

Figure 2:
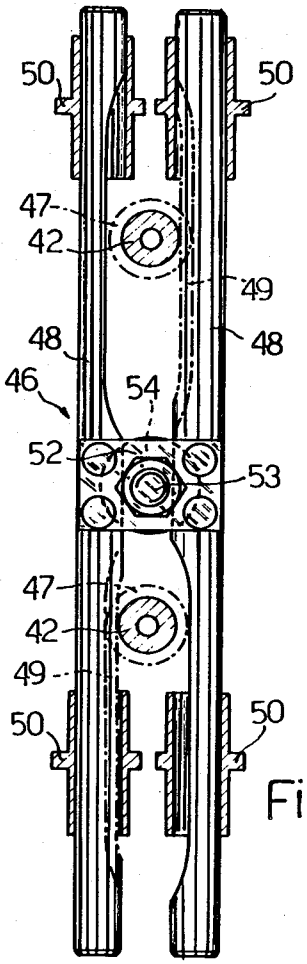
FIG. 2 shows a larger-scale axial section of a detail in FIG. 1.
Figure 1A:
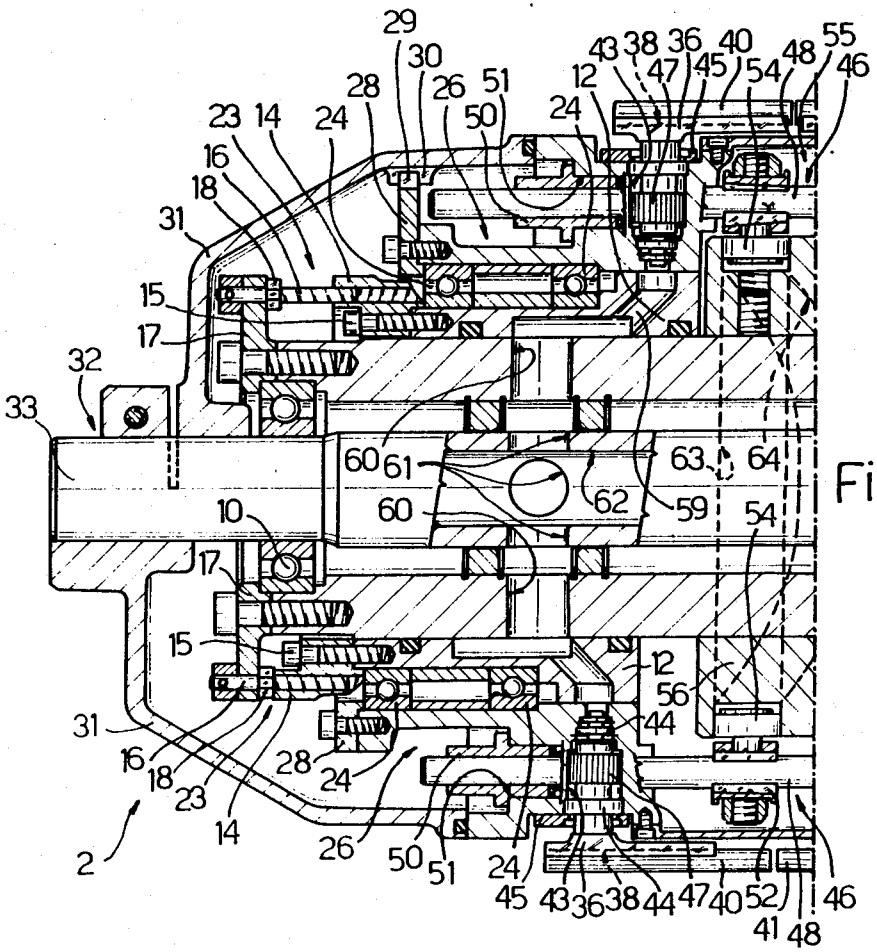
FIGS. 1*a* and 1*b* show a partial axial section of a device for spacing and turning over cigarette lengths according to the method covered by the present invention, a top and bottom portion of the diagram showing the device in two different operating arrangements.
Figure 1B:
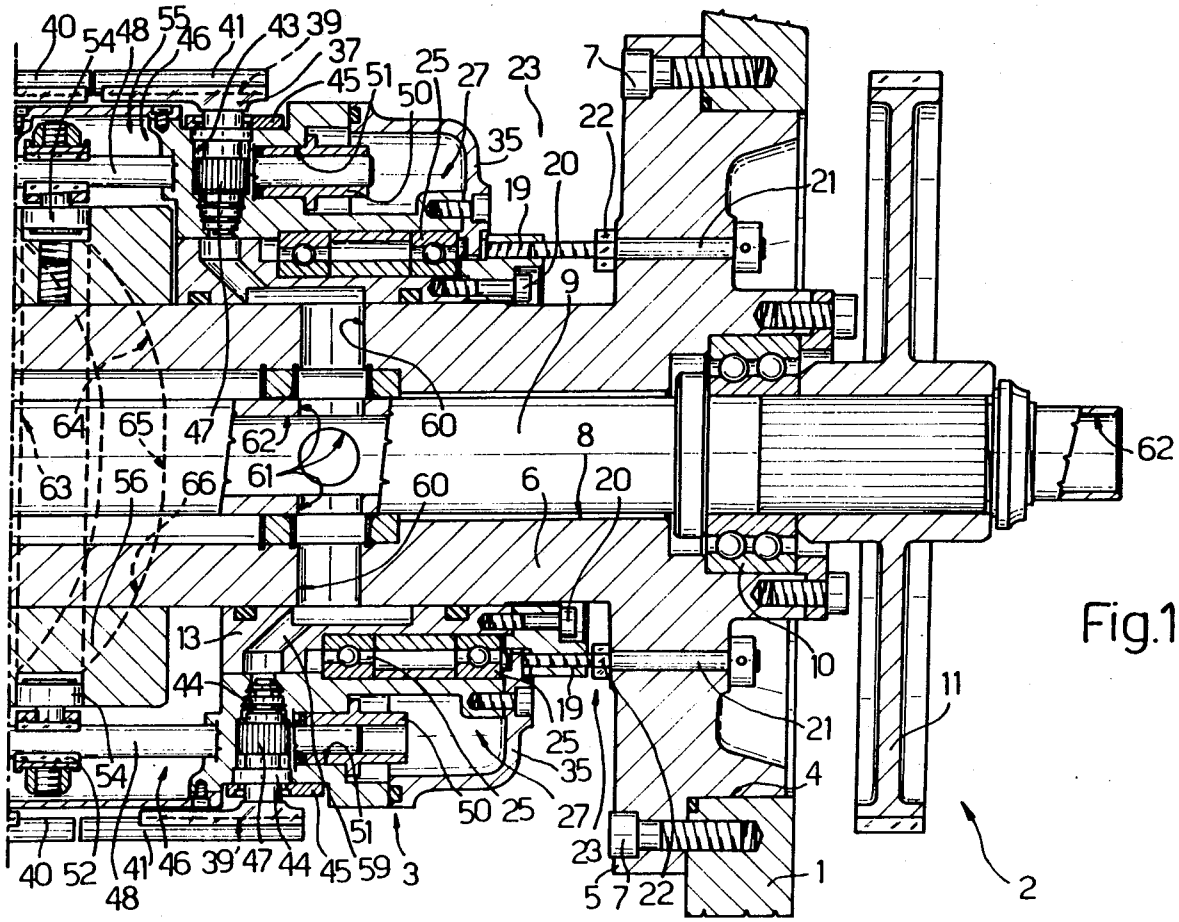
Figure 3:
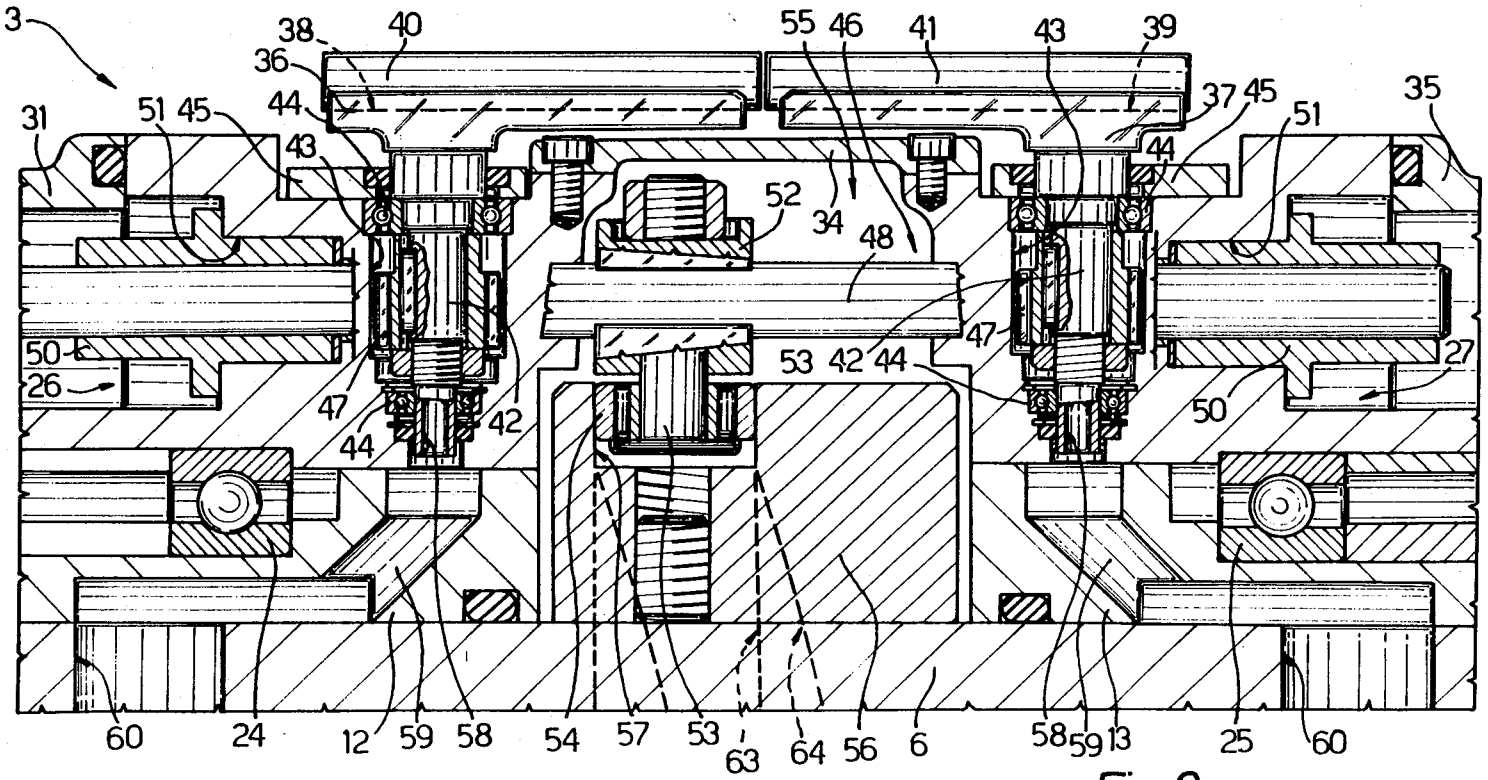
FIG. 3 shows a plan view of part of the FIG. 2 detail.

Number 1 in FIG. 1 indicates a wall on a filter assembling machine indicated as a whole by 2 and comprising a conveyor consisting of a turn-over and spacing roller indicated as a whole by 3 and supported in rotary manner by wall 1. In more detail, wall 1 presents an opening 4 closed off by an annular end flange 5 on a cylindrical coupling 6 made integral with wall 1 by a number of screws 7.

Through hole 4 and centre hole 8 on coupling 6 and flange 5, a shaft 9 is mounted in rotary manner for driving roller 3. Shaft 9 is supported in rotary manner by coupling 6, via the insertion of a pair of end bearings 10, and is fitted, on one end extending inside wall 1, with a gear 11 connected (in a manner not shown) to a drive motor (not shown). The outer surface of coupling 6 is fitted, in axially sliding manner, with two tubular slides, 12 and 13, the first of which is located next to the free end of coupling 6 and is fitted, on its outer end, with an annular body 14. The latter is made integral with slide 12 by means of a number of screws 15 and is connected, by means of a number of regulating screws 16, to an annular flange 17 integral with and extending radially outwards from the free end of coupling 6.

Each screw 16 is provided with a regulating nut 18 for setting slide 12 in a given axial position along coupling 6. Slide 13 is also provided, on the end facing wall 1, with an annular body 19 made integral with slide 13 by means of a number of screws 20 and connected to flange 5 by means of a number of regulating screws 21. Each screw 21 is provided with a regulating nut 22 for setting slide 13 in a given axial position along coupling 6.

Screws 16 and 21 and respective nuts 18 and 22 combine to form a format regulating device 23 the function of which will be described in more detail later on.

Slides 12 and 13 support, in rotary manner via the insertion of respective pairs of bearings 24 and 25, respective annular half-rollers 26 and 27, the first of which is fitted on its outer end with a ring 28 having an outer radial tooth 29. The latter engages an inner radial recess 30 on a bell 31 angularly connected, by means of a splined coupling 32, to an end section 33 on shaft 9 projecting outward of flange 17.

Bell 31 acts as a drive for transmitting motion between shaft 9 and half-roller 26 which, in turn, is made angularly integral with half-roller 27 by means of annular body 34. Whenever the format is adjusted using device 23, body 34 must be replaced with another body 34 of the appropriate length.

The end of half-roller 27 facing wall 1 is fitted with a bell cover 35.

Half-rollers 26 and 27 combine to form roller 3 and support respective outer rings of nacelles, 36 and 37, defining respective recesses, 38 and 39, for cigarette lengths 40 and 41.

At a given mid point, each nacelle 36, 37 is connected to a radial shaft or pin 42 mounted in such a manner as to turn through a respective hole 43 formed essentially radially through respective half-roller 26, 27.

Inside its respective hole 43, each pin 42 is supported by a pair of bearings 44 and is held inside hole 43 by means of an outer cover 45.

Each pin 42 on half-roller 26 corresponds with a pin 42 on half-roller 27 via an actuating unit 46 comprising a gear 47, fitted on to each of the said two pins 42, and a pair of parallel rods 48 facing each other. The said rods 48 extend essentially axially in relation to roller 3 and on opposite sides in relation to the said two gears 47, and are each provided with a rack 49 connected to a respective gear 47.

Each rod 48 is supported in sliding manner, at its opposite ends, by two bushes 50 mounted through respective axial holes 51, one each in half-rollers 26 and 27, and is made integral with the other rod 48 by means of a centre connecting body 52 located between half-rollers 26 and 27. Body 52 is pierced by a screw 53 essentially radial in relation to roller 3 and fitted on its inner end with a rotary tappet roller 54.

All the actuating units 46 arranged round roller 3 form part of an actuating device 55 also comprising a centre drum cam 56 fitted on to a centre portion of coupling 6. The outer surface of cam 56 is provided with a groove 57 engaged by all the rollers 54 and shaped in such a manner as to move each pair of rods 48 back and forth for each turn of roller 3 round the axis of shaft 9, such displacement commencing from the idle position shown in FIG. 1 which shows respective recesses 38 and 39 aligned coaxially with each other.

For at least part of its rotation round the axis of shaft 9, each recess 38, 39 communicates with a suction source (not shown) through an axial hole 58 on respective pin 42, a duct 59 through respective slide 12, 13, a duct 60 through coupling 6, radial holes 61 through shaft 9 and an axial hole 62 formed along shaft 9 and closed off outwardly by end section 33.

Before being operated, filter assembling machine 2 is set according to the length or format of the cigarettes being manufactured.

For this purpose, with roller 3 stationary, nuts 18 and 22 on regulating device 23 are loosened to enable slides 12 and 13 to slide freely both in relation to coupling 6 and in relation to each other by removing body 34.

Screws 16 and 21 are then adjusted for regulating the axial position of slides 12 and 13, in such a manner as to set the axes of rotation of each pair of corresponding nacelles 36 and 37 at such a distance apart that, when each of the said two nacelles, 36 and 37, is turned 180° in relation to the idle position shown in FIG. 1, the distance between the ends of the said nacelles thus coming to face each other is at least equal to the length of a double filter, i.e. a length of filter twice as long as the filter to be fitted on to each of cigarette lengths 40 and 41.

Once this setting has been made, nuts 18 and 22 are tightened and the two half-rollers 26 and 27 once more connected together using a new body 34 of the appropriate length.

The above procedure is clearly shown in FIG. 1, the top and bottom parts of which show respective arrangements for handling minimum and maximum lengths.

Rotation of shaft 9, by drive components not shown and connected to gear 11, is transmitted by bell 31 to half-roller 26 and by the latter to half-roller 27 via body 34.

As roller 3 turns round, each pair of nacelles 36 and 37, in the idle position shown in FIG. 1, moves through the point of tangency with a supply roller (not shown) from which it receives a pair of cigarette lengths, 40 and 41, held by suction inside respective recesses 38 and 39.

The said cigarette lengths 40 and 41 are initially aligned coaxially with each other, with their perfectly smooth end faces essentially contacting.

As each pair of nacelles 36 and 37 moves through the said point of tangency, the respective tappet roller 54 moves along an essentially straightline section of groove 57 indicated by the dot-and-dash line and number 63 in FIG. 1. As roller 3 turns on round, roller 54 starts moving along a sloping section 64 of groove 57 indicated by the dashes in FIG. 1. By so doing, roller 54 starts moving parallel with the axis of shaft 9, resulting in axial displacement of respective racks 49 and consequent rotation of gears 47 and respective nacelles 36 and 37 round the axes of respective pins 42.

Racks 49 and gears 47 thus constitute drive means for transmitting motion between the said cam means 56 and nacelles 36 and 37.

The slope and length of section 64 are such as to turn nacelles 36 and 37 through 180° in opposite directions, so that, at the end of section 64, the said two cigarette lengths 40 and 41 are once more perfectly aligned, but with the said perfectly smooth ends facing outward and the facing ends separated by at least the length of the said double filter.

Roller 54 then leaves section 64 to engage a straightline section 65 on groove 57, whereas nacelles 36 and 37 move through a point of tangency with a pick-off roller (not shown) which picks up cigarette lengths 40 and 41, spaced and turned over as described, and feeds them, in the same mutual position, to further handling stations (not shown). As it moves on, roller 54 moves back to section 63 through a further sloping section 66 on groove 57, thus bringing nacelles 36 and 37 back to the starting position shown in FIG. 1 for receiving another two cigarette lengths, 40 and 41, from the said supply roller (not shown).

From the foregoing description, roller 3 clearly provides, in one single operation, for spacing each cigarette length 40 apart from its respective cigarette length 41 and so enabling insertion of the said double filter (not shown), as well as for turning over each pair of cigarette lengths 40 and 41 in such a manner that the perfectly smooth ends face outwards, i.e. the opposite way to the end the filter is to be assembled on to.

What is claimed is:

1. Method of spacing and turning over two coaxial cigarette lengths (40, 41) on a filter assembling machine (2), characterised by the fact that it comprises stages consisting in:

conveying the said two cigarette lengths (40, 41) arranged essentially contacting each other over a first end face, on a conveyor (3) travelling in a direction essentially perpendicular to the axis of the said cigarette lengths (40, 41), the said conveyor (3) comprising, for each pair of the said cigarette lengths (40, 41) two coaxial recesses (38, 39) mounted so as to turn on the said conveyor (3) round respective axes of rotation essentially crosswise in relation to the said travelling direction, and turning the said two recesses (38, 39) essentially 180° round the respective said axes of rotation, so as to make them once more coaxial with each other; the said axes of rotation of the said two recesses (38, 39) being set apart in such a manner that, when turned through the said 180°, the said two cigarette lengths (40, 41) are arranged with their second ends facing each other and separated by at least the length of a double filter.

2. Method according to claim 1, characterised by the fact that the said two recesses (38, 39) are turned round their respective axes of rotation by actuating means (46) comprising fixed cam means (56), extending along the said conveyor (3), and drive means (47, 49) moving with the said conveyor (3) and inserted between the said two recesses (38, 39) and the said cam means (56).

3. Method according to claim 2, characterised by the fact that the said conveyor is a roller (3) turning round its own axis, the said cam means consisting of a drum cam (56).

4. Method according to claim 3, characterised by the fact that the said roller (3) comprises two coaxial half-rollers (26, 27) the distance between which is adjustable; the said two half-rollers (26, 27) being angularly integral with each other and each supporting one respective recess of each pair of recesses (38, 39).

5. Method according to claim 4, characterised by the fact that the said drive means comprise, for each pair of the said recesses (38, 39), a rack device (49) extending between the said two half-rollers (26, 27); the said rack device (49) being connected to the said cam (56) so as to move back and forth parallel with the said axis of rotation of the said roller (3).

6. Method according to claim 5, characterised by the fact that each said recess (38, 39) corresponds to a pin (42) mounted in rotary manner through the respective said half-roller (26, 27); the said drive means also comprising, for each said recess (38, 39), a gear (47) connected to the said rack device (49) and fitted on to the said pin (42).

* * * * *